US011089853B2

(12) United States Patent
Igarashi

(10) Patent No.: US 11,089,853 B2
(45) Date of Patent: Aug. 17, 2021

(54) BAG AND FASTENER

(71) Applicant: POWER SUPPORT CO., LTD., Tokyo (JP)

(72) Inventor: Katsushi Igarashi, Tokyo (JP)

(73) Assignee: POWER SUPPORT CO., LTD., Tokyo (JP)

( * ) Notice: Subject to any disclaimer, the term of this patent is extended or adjusted under 35 U.S.C. 154(b) by 271 days.

(21) Appl. No.: 16/091,603

(22) PCT Filed: Apr. 21, 2017

(86) PCT No.: PCT/JP2017/016011
§ 371 (c)(1),
(2) Date: Oct. 5, 2018

(87) PCT Pub. No.: WO2017/195571
PCT Pub. Date: Nov. 16, 2017

(65) Prior Publication Data

US 2019/0125047 A1 May 2, 2019

(30) Foreign Application Priority Data

May 9, 2016 (JP) ..... JP2016-093597

(51) Int. Cl.
*A45C 9/00* (2006.01)
*A45C 3/00* (2006.01)
(Continued)

(52) U.S. Cl.
CPC ..... *A45C 9/00* (2013.01); *A45C 3/00* (2013.01); *A45C 7/0068* (2013.01); *A45C 11/00* (2013.01);
(Continued)

(58) Field of Classification Search
CPC ..... A45C 7/0068; A45C 2200/15; A45C 2011/001; A45C 9/00; A45C 13/103; A45C 13/1092; A45C 13/1038; A45C 3/00
See application file for complete search history.

(56) References Cited

U.S. PATENT DOCUMENTS 4,577,376 A * 3/1986 Clendinen ..... A44B 17/0029 24/624
5,295,315 A 3/1994 Osawa et al.
(Continued)

FOREIGN PATENT DOCUMENTS

CN 1036129 A 10/1989
CN 201182283 Y 1/2009
(Continued)

OTHER PUBLICATIONS

International Search Report dated Jun. 6, 2017 of corresponding International Application No. PCT/JP2017/016011; 3 pgs.
(Continued)

*Primary Examiner* — James N Smalley
*Assistant Examiner* — Jennifer Castriotta
(74) *Attorney, Agent, or Firm* — Maier & Maier, PLLC

(57) ABSTRACT

To provide a technology capable of easily constructing a headphone stand in a coffee shop or the like. A bag includes a bag body including a front part and a rear part that face each other, an opening provided on an upper edge of the bag body, and a shape keeping part that prevents closing of the opening and keeps the bag body expanded.

3 Claims, 9 Drawing Sheets

(51) Int. Cl.

| | |
|---|---|
| ***A45C 13/10*** | (2006.01) |
| ***A45C 11/00*** | (2006.01) |
| ***A45C 7/00*** | (2006.01) |
| ***A44B 19/06*** | (2006.01) |

(52) U.S. Cl.
CPC ..... *A45C 13/103* (2013.01); *A45C 13/1038* (2013.01); *A45C 13/1092* (2013.01); *A44B 19/06* (2013.01); *A45C 2011/001* (2013.01); *A45C 2200/15* (2013.01)

(56) References Cited

U.S. PATENT DOCUMENTS

| | | | | |
|---|---|---|---|---|
| 6,006,915 | A * | 12/1999 | Moor | A45C 3/00 190/102 |
| 2013/0199020 | A1 | 8/2013 | Frydlewski et al. | |
| 2015/0074955 | A1 | 3/2015 | Frydlewski et al. | |
| 2018/0020780 | A1 | 1/2018 | Frydlewski et al. | |

FOREIGN PATENT DOCUMENTS

| | | | |
|---|---|---|---|
| CN | 201303668 | Y | 9/2009 |
| CN | 201591208 | U | 9/2010 |
| CN | 202407529 | U | 9/2012 |
| CN | 203182150 | U | 9/2013 |
| CN | 205053046 | U | 3/2016 |
| JP | S58-82114 | U | 6/1983 |
| JP | 1451771 | S | 9/2012 |
| WO | 2015/128621 | A1 | 9/2015 |

OTHER PUBLICATIONS

Chinese Office Action dated Oct. 20, 2020, in connection with corresponding CN Application No. 201780016508.2 (12 pp., including machine-generated English translation).
Chinese Office Action dated Feb. 24, 2021, in connection with corresponding CN Application No. 201780016508.2 (14 pp., including machine-generated English translation).

* cited by examiner

BEFORE MOUNTING

AFTER MOUNTING

BAG AND FASTENER

FIELD

The present invention relates to a bag and fastener.

BACKGROUND

Regular headphone users have increased in recent years. A headphone which is not in use at home is typically kept hung on a headphone stand as disclosed in Patent Literature 1.

[Patent Literature 1] Design Registration No. 1451771

SUMMARY

Many regular headphone users use headphones also in a coffee shop or the like. However, there is no headphone stand in coffee shops and therefore headphone users are often troubled with the absence of a place to place the headphone when they leave their seat.

The present invention has been made in view of the foregoing, and an object thereof is to provide a technology capable of easily constructing a headphone stand in a coffee shop or the like.

The present invention provides a bag including a bag body including a front part and a rear part that face each other, an opening provided on an upper edge of the bag body, and a shape keeping part that prevents closing of the opening and keeps the bag body expanded.

The present inventor intensively considered construction of a headphone stand using an object near the user and noted a bag containing headphone and carried by the user. The present inventor then found that if the bag is provided with a shape keeping part to keep the bag expanded, the bag can be stably erected by turning the bag inside out and that the bag turned inside out and erected can be suitably used as a headphone stand. The present inventor also found that the bag turned inside out and erected can be used not only as a headphone stand but also as a placement base to place another object and can be also used as an electronic device by inserting a functional component, such as a speaker, into a side of the bag and then completed the present invention.

As seen above, the bag of the present invention is usually a compact bag, but the user can cause the bag to perform a desired function by keeping the bag body expanded using the shape keeping part, turning the bag inside out, and then erecting it.

Various embodiments of the present invention are described below as examples. Any embodiments below can be combined with each other.

Preferably, the shape keeping part includes a pair of connectors that are disposed adjacent to both ends of the bag body and can be connected to each other.

Preferably, the pair of connectors are a pair of engagement parts that can be engaged with each other.

Preferably, a fastener is disposed on the opening, and the pair of connectors are disposed on both ends of the fastener.

Preferably, each of the pair of the connectors is formed in a plate shape, one connector of the pair of the connectors includes an opening portion penetrating the one connector, and the other connector of the pair of the connectors includes an engagement part and a notch.

Preferably, the engagement part is closer to a tip of the other connector than the notch, a width of the engagement part is wider than a width of the notch, the engaging portion is configured to, when the notch is inserted into the opening portion of the one connector, be hooked on the one connector.

Preferably, the shape keeping part includes an inside support member disposed inside the bag body and configured to prevent the front part and the rear part from coming close to each other.

Preferably, the shape keeping part includes a part shape keeping member formed of a thin sheet and disposed on at least one surface of the front part and the rear part, and the part shape keeping member is configured to, when the at least one having the part shape keeping member disposed thereon is deformed, keep the at least one deformed.

Preferably, a deformation promotion part is disposed near a lower edge of the bag body and the deformation promotion part is configured to form a protrusion protruding from a side of the bag body toward the center of the bag body, and the bag body is configured such that deformation of the bag body is promoted by the deformation promotion part and a placement surface is formed around the deformation promotion part.

Preferably, there is provided a bag including a bag body and an opening provided on an upper edge of the bag body, a deformation promotion part is disposed near a lower edge of the bag body and the deformation promotion part is configured to form a protrusion protruding from a side of the bag body toward the center of the bag body, and the bag body is configured such that deformation of the bag body is promoted by the deformation promotion part and a placement surface is formed around the deformation promotion part.

Preferably, there is provided a fastener including connectors disposed on both ends thereof, wherein the connectors can be connected to each other.

BRIEF DESCRIPTION OF DRAWINGS

FIGS. 3A and 3B are drawings showing two connectors corresponding to a shape keeping part according to the first embodiment of the present invention, in which FIG. 3A shows a connector 5; and FIG. 3B shows a connector 6.

FIGS. 5A and 5B are drawings showing a state in which the bag 100 is deformed using a deformation promotion part 7 as a boundary and a placement surface 10 is formed around the deformation promotion part 7, in which FIG. 5A is a front view; and FIG. 5B is a perspective view.

DETAILED DESCRIPTION

Figure 1:
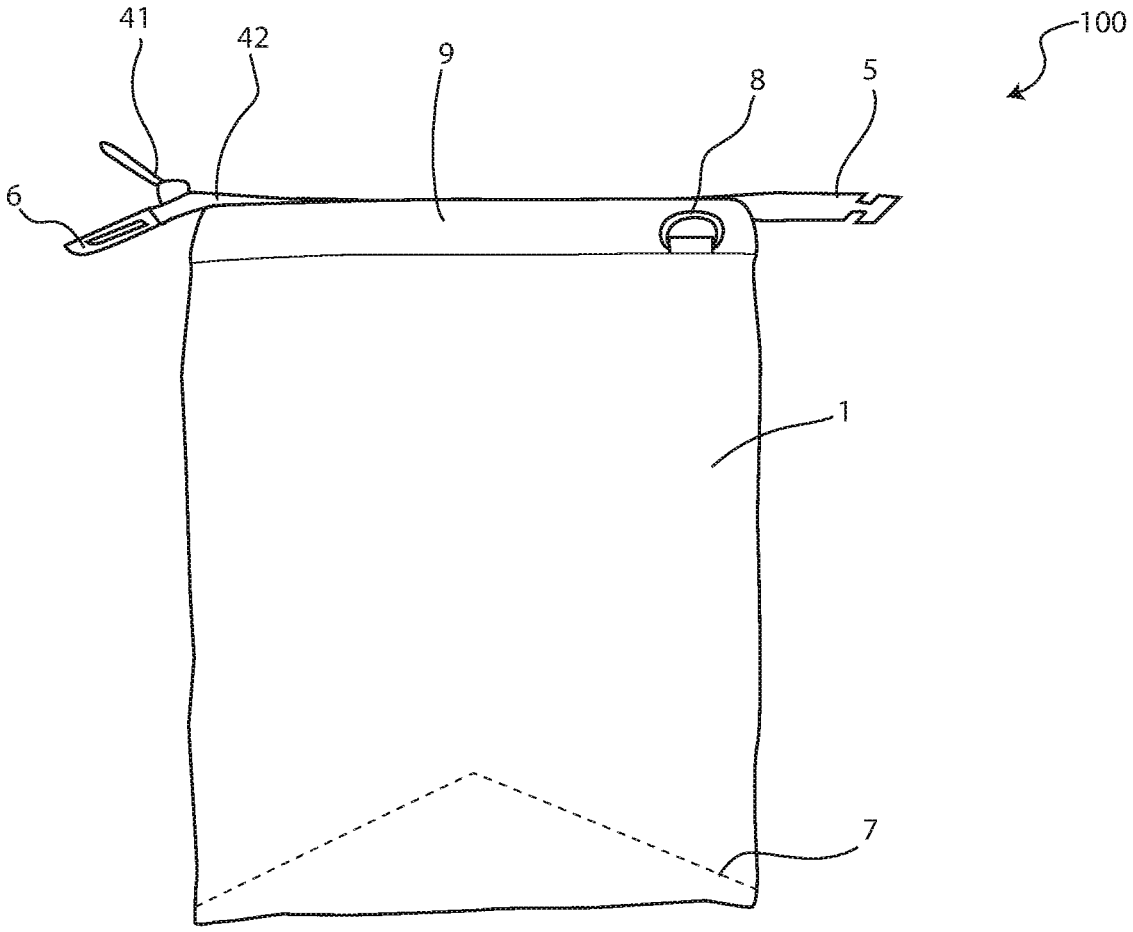
FIG. 1 is a front view of a bag 100 according to a first embodiment of the present invention.

Now, embodiments of the present invention will be described. However, the embodiments below are illustrative only and do not limit the scope of the present invention.

1. First Embodiment

Referring now to FIGS. 1 to 7, a bag 100 according to a first embodiment of the present invention will be described. The bag 100 includes a bag body including a front part 1 shown in FIG. 1 and a rear part 2 shown in FIG. 2, an opening 3 provided on the upper edge of the bag shown in FIG. 4, and a shape keeping part that prevents closing of the opening 3 and keeps the bag body expanded. As shown in FIGS. 3A and 3B, in the present embodiment, the shape keeping part is made up of connectors 5, 6 that are disposed on both ends of a fastener 4 and can be connected to each other.

In the present embodiment, the bag body has a two-layer structure and comprises an outer leather bag body and an inner felt bag body. Note that these bodies need not be formed of the above materials and may be formed of any material in accordance with the application. Also, in the present embodiment, upper portions of the front part 1 and rear part 2 are formed of felt 9 in order to improve the appearance.

The fastener 4 is disposed along the length direction of the opening 3. The bag body can contain an object in the bag body with the opening 3 opened. The fastener 4 includes a slider 41, a tape 42, and elements 43. The slider 41 has a function of engaging the elements 43 with each other, and the opening 3 can be switched between open and close states by moving the slider 41. The tape 42 is a part on which the elements 43 are disposed. The elements 43 are engaged with the slider 41 so that the slider 41 can move. When the elements 43 are engaged with each other and thus closed, the opening 3 is placed in a close state.

Both ends of the fastener 4 are adjacent to both ends in the length direction of the opening 3 and are provided with connectors 5, 6. The connectors 5, 6 can be connected to each other. By connecting the connectors 5, 6 to each other, both ends in the length direction of the opening 3 come close to each other.

Figure 3A:
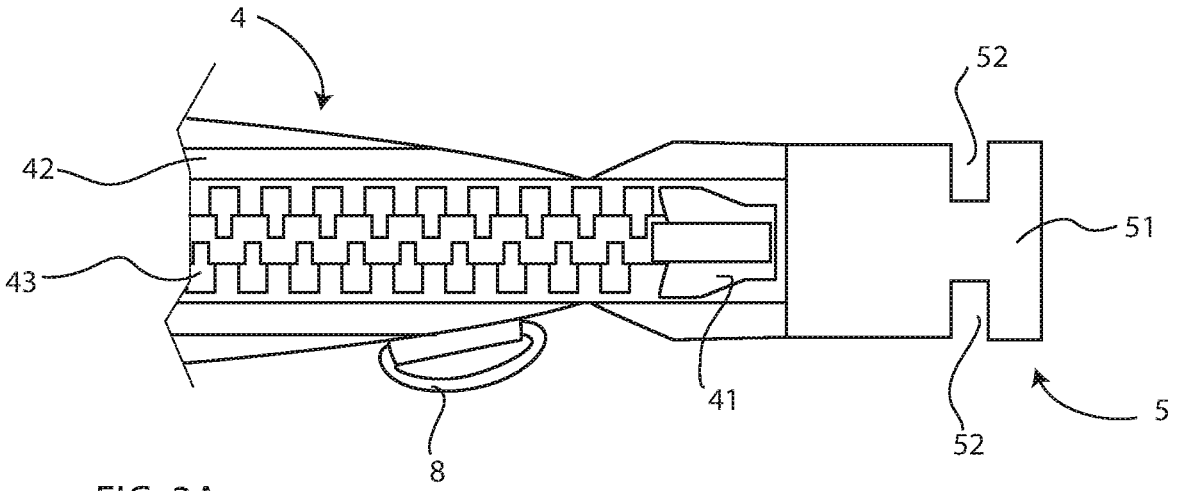
Figure 3B:
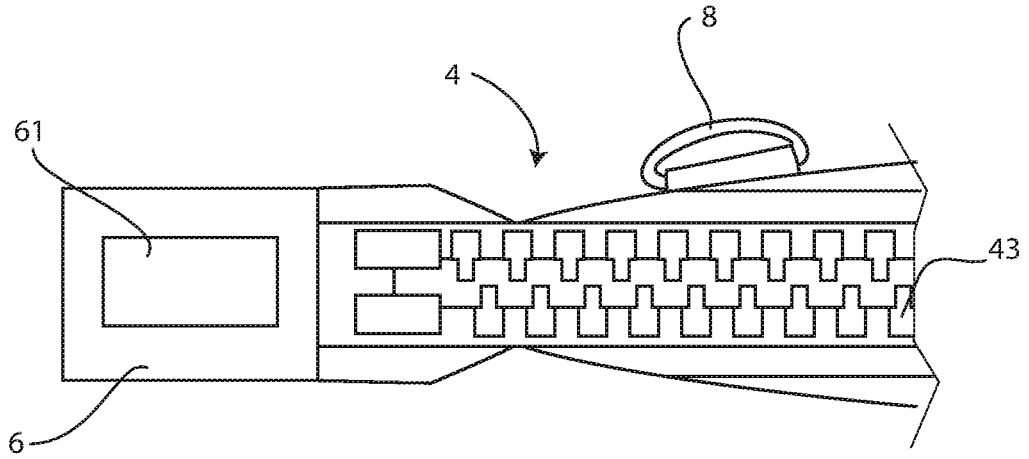
Figure 4:
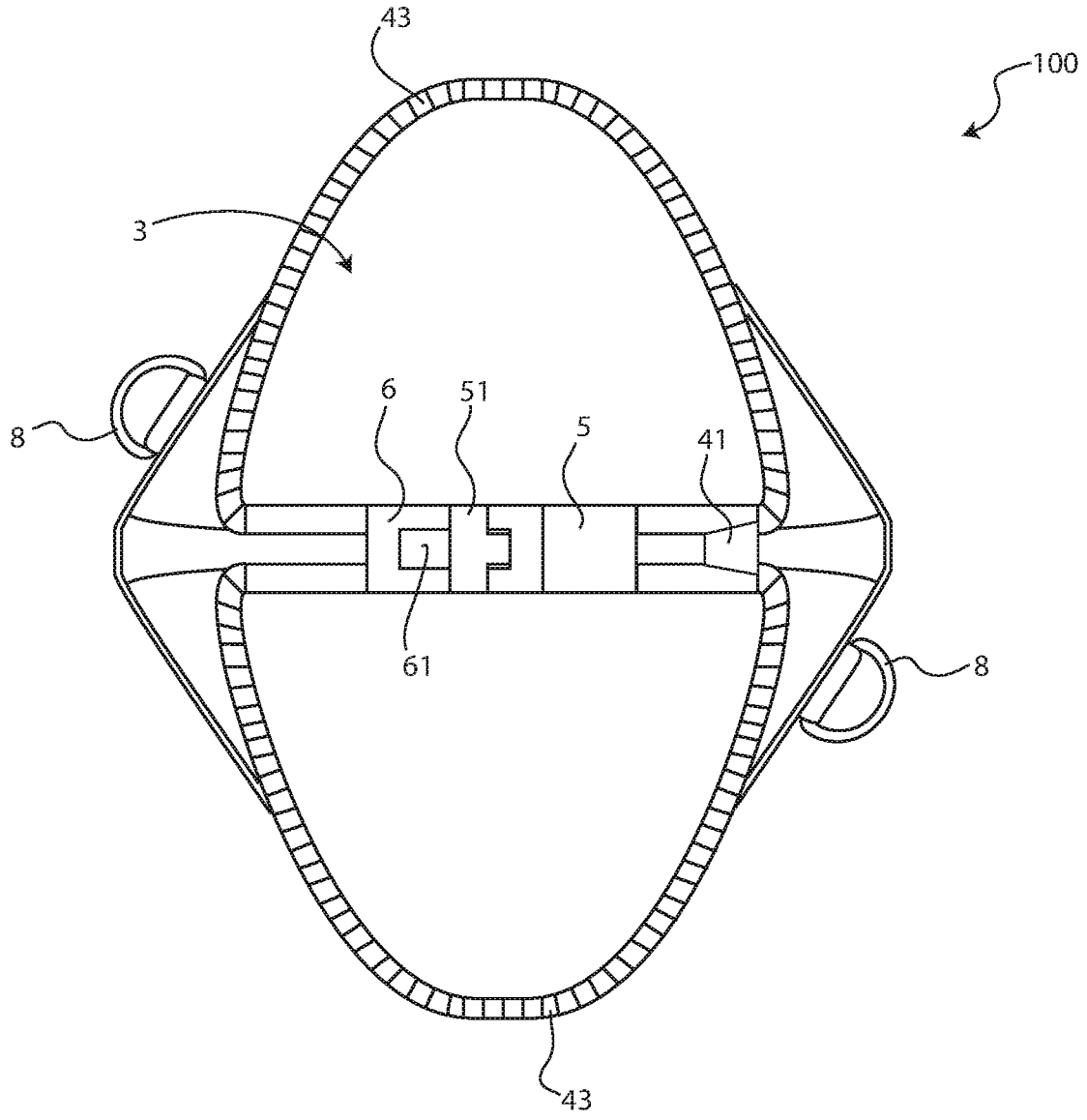
FIG. 4 is a drawing showing a state in which the connectors 5, 6 are mounted to each other.

As shown in FIGS. 3A and 3B, in the present embodiment, the connector 5 includes an engagement part 51 and notches 52. The connector 6 has an opening 61. As shown in FIG. 4, by inserting the engagement part 51 into the opening 61 and rotating it by approximately 90°, a T-shaped portion of the engagement part 51 is caught on both sides of the opening 61 and thus the connectors 5, 6 are mounted to each other. As seen above, the connectors 5, 6 are configured to be connectable to each other by engagement. By connecting the connectors 5, 6 to each other, the bag body is kept expanded. That is, the fastener 4 can be said to be a fastener having the connectors (connectors 5, 6) connectable to each other on both ends thereof.

Figure 2:
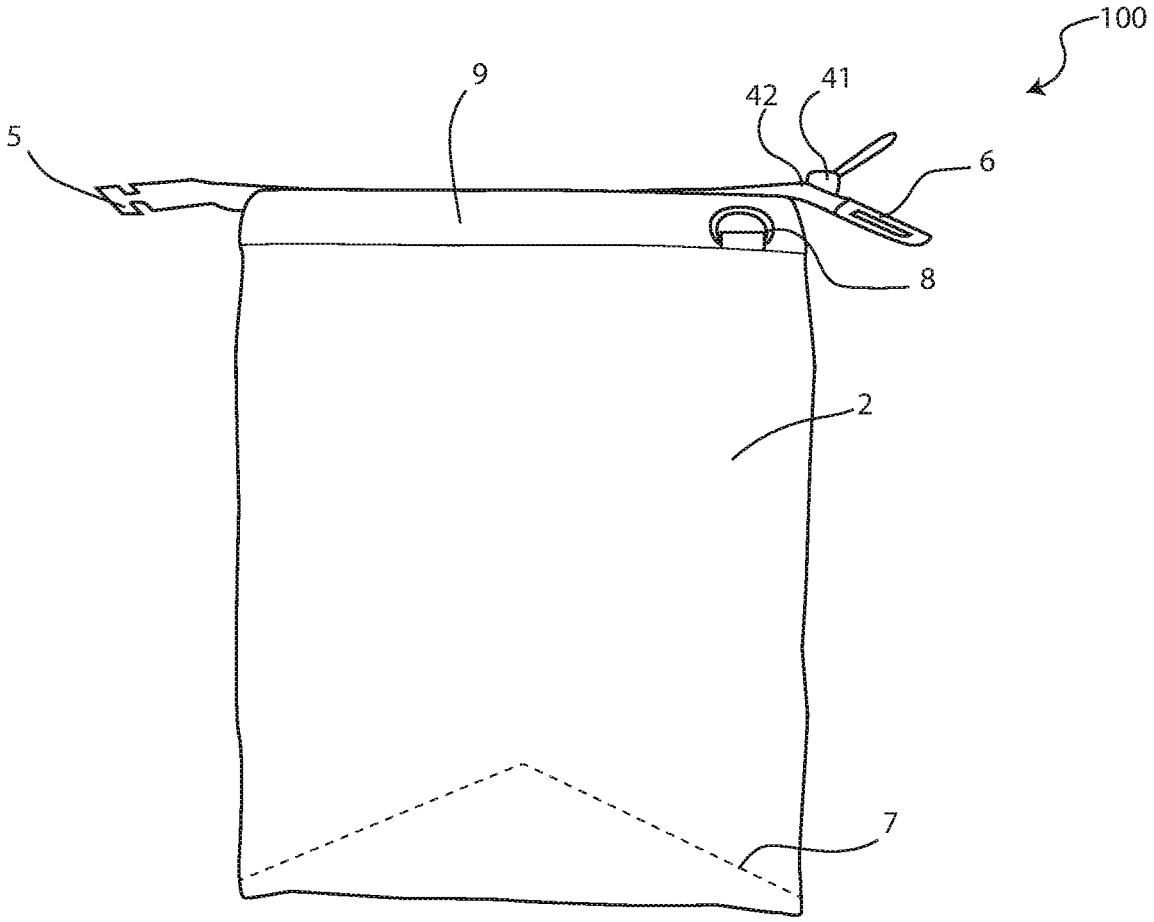
FIG. 2 is a rear view of the bag 100 of the first embodiment of the present invention.

As shown in FIGS. 1 and 2, deformation promotion parts 7 (shown by white broken lines; the same applies to other drawings) configured to form protrusions protruding from the side surfaces of the bag body toward the center of the bag body are disposed near lower edges of the front part 1 and rear part 2 of the bag body. In the present embodiment, the deformation promotion parts 7 are seams, and the front part 1 and rear part 2 can be folded toward the inside of the bag body along the deformation promotion parts 7. The inner felt bag body preferably has a shape that is not present in a triangular region formed by the deformation promotion parts 7, front part 1, and rear part 2. The reason is that the absence of the felt bag body in the triangular region allows the front part 1 and rear part 2 to be easily folded toward the inside of the bag body.

Figure 5A:
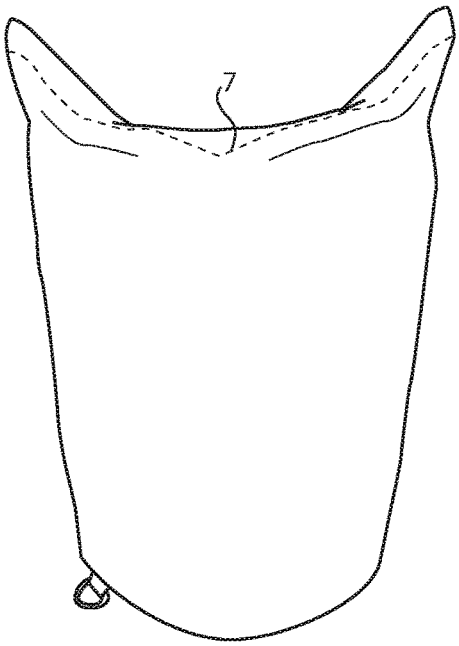
Figure 5B:
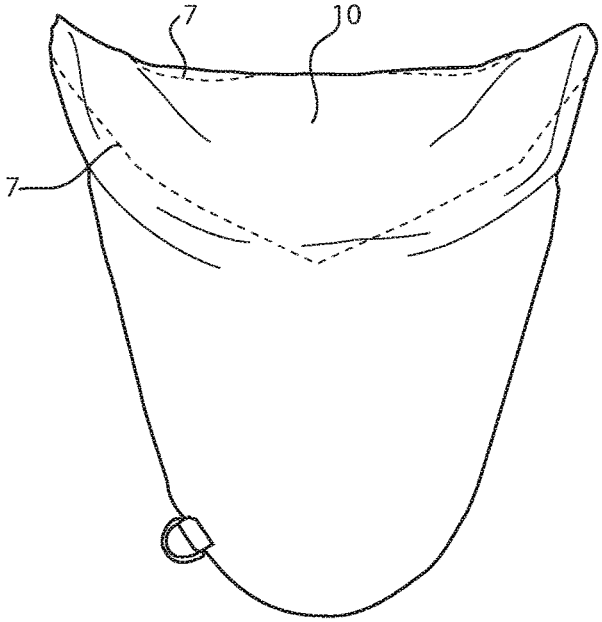

When the front part 1 and rear part 2 are folded toward the inside of the bag body along the deformation promotion parts 7 with the connectors 5, 6 mounted to each other and then the bag 100 is turned over, the bag 100 becomes a state shown in FIGS. 5A and 5B. Since the opening 3 is prevented from being closed by the connectors 5, 6 and the bag 100 is kept expanded, the bag 100 can stand on its own on the table or floor. Also, by folding the front part 1 and rear part 2 toward the inside of the bag body along the deformation promotion parts 7, a placement surface 10 is formed around the deformation promotion parts 7.

Figure 6:
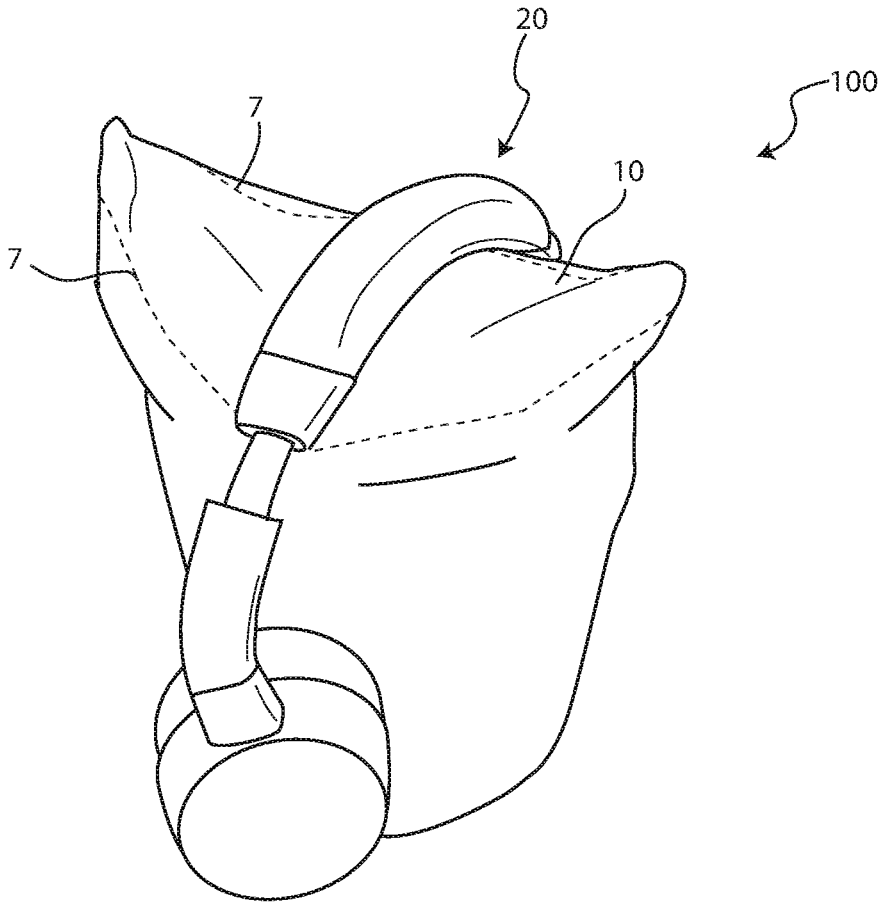
FIG. 6 is a drawing showing a state in which an object is placed on a placement surface 10 and, specifically, showing a state in which a headphone 20 is placed on the placement surface 10 in the first embodiment.

FIG. 6 is a drawing showing an example use of the bag 100 in the state in FIGS. 5A and 5B. While, in the present embodiment, a headphone 20 is placed on the placement surface 10, any other object may be placed on the placement surface 10. For example, a portable information terminal such as a smartphone, or a small article such as a pen, glasses, or chewing gum may be placed on the placement surface 10.

Figure 7:
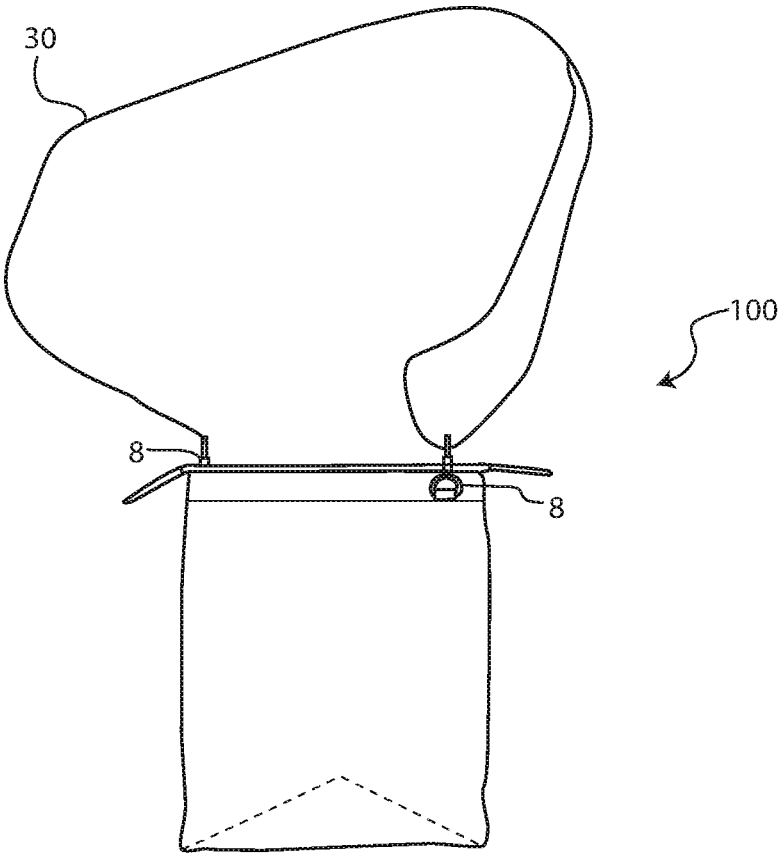
FIG. 7 is a drawing showing a state in which a string member 30 is mounted on the bag 100 according to the first embodiment of the present invention and, specifically, showing a state in which the string member 30 is mounted on two string member mounting rings 8 disposed on the bag 100.

As shown in FIGS. 1 and 2, string member mounting rings 8 are disposed near the boundaries between the front part 1 and rear part 2, and the felt 9. As shown in FIG. 7, both ends of a string member 30 may be mounted to the bag 100 through the string member mounting rings 8 as necessary.

As described above, according to the present embodiment, the bag 100 turned over can stand on its own on the table, and an object can be placed on the placement surface 10 formed by the deformation promotion parts 7. Thus, a placement place for an object such as the headphone 20 can be secured even on a narrow table in a coffee shop or the like.

The present invention may be carried out in the following forms.

While, in the present embodiment, the engagement part 51 (T-shaped portion) and opening 61 of the connectors 5, 6 are engaged with each other, the connectors 5, 6 may be connected to each other using a different element (e.g., button, eyelet, hook-and-loop fastener, string).

While, in the present embodiment, the connectors 5, 6 are connected to each other by engaging them with each other, the connectors 5, 6 may be connected to each other by magnetic force or adhesion.

Figure 8A:
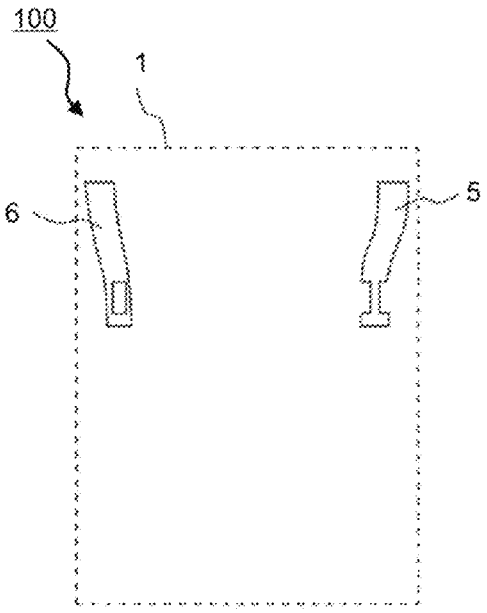
FIGS. 8A and 8B are schematic drawings showing an example in which the connectors 5, 6 are disposed adjacent to both ends of the bag body.
Figure 8B:
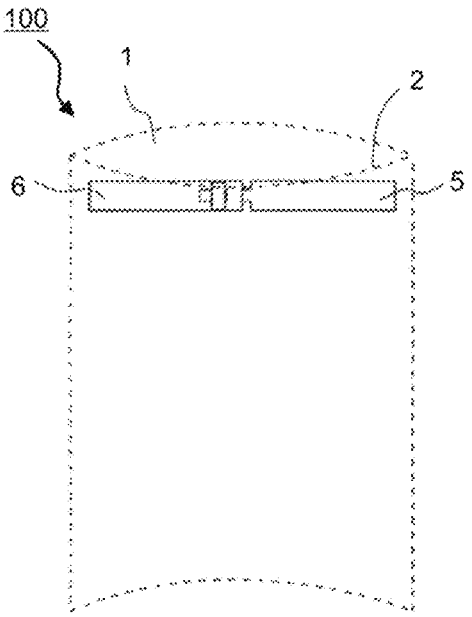

While, in the present embodiment, the fastener 4 is disposed on the opening 3, the fastener 4 may be omitted. In this case, the connectors 5, 6 may be disposed in any positions adjacent to both ends in the length direction of the bag body. For example, the connectors 5, 6 may be disposed in regions Y and Z in FIG. 9. For another example, as shown in FIG. 8A, the connectors 5, 6 may be disposed inside the bag body. In this case, the connectors 5, 6 becomes a state shown in FIG. 8B by connecting them to each other.

While the bag body including the front part and rear part facing each other has been described, the present embodiment can also be applied to a bag shaped such that the front part and rear part are not clearly distinguished from each other. In this case, a part of the bag body is regarded as the front part, and a part facing the front part is regarded as the rear part.

2. Second Embodiment

Figure 9:
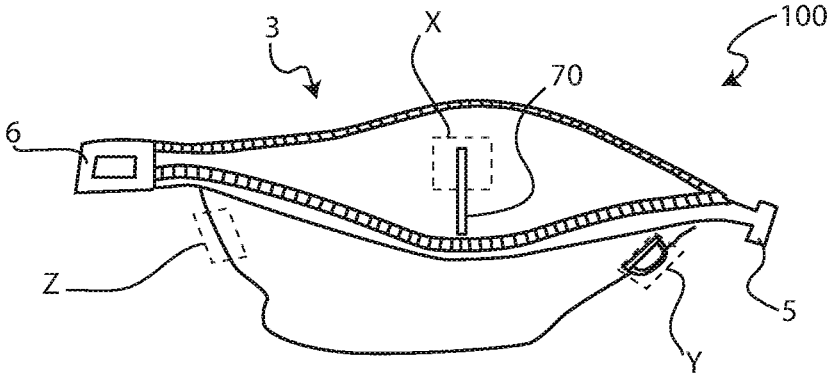
FIG. 9 is a drawing showing a second embodiment of the present invention and shows an example of an inside support member 70 that supports a front part 1 and a rear part 2 of a bag 100 from inside.

Referring now to FIG. 9, a second embodiment of the present invention will be described. The present embodiment is similar to the first embodiment, and a major difference therebetween is the configuration of a shape keeping part. The following description will focus on the difference.

In the present embodiment, as shown in FIG. 9, an inside support member 70 is disposed in a bag body and forms a shape keeping part. Since the inside support member 70 prevents a front part 1 and a rear part 2 from coming close to each other, the bag body is kept expanded. If the bag 100 is not deformed, the inside support member 70 may be stored in, for example, a pocket inside the bag 100 in advance. Or, a part of the inside support member 70 may be fixed to the inner surface (e.g., a portion shown by a region X) of the bag 100 in advance.

The inside support member 70 may have any shape as long as it can prevent the front part 1 and rear part 2 from coming close to each other. For example, it may have a rod shape as shown in FIG. 9, or may have any other shape such as a circle.

3. Third Embodiment

Next, a third embodiment of the present invention will be described. The present embodiment is similar to the first embodiment, and a major difference therebetween is the configuration of a shape keeping part. The following description will focus on the difference.

In the present embodiment, a front part 1 and a rear part 2 of a bag body are provided with part shape keeping members that when the front part 1 or rear part 2 is deformed, keep the part deformed, and the part shape keeping members form a shape keeping part. The part shape keeping members are formed of members, such as metal sheets, that can be easily plastically deformed. Such members are inserted into the front part 1 and rear part 2 or pasted on them. Thus, when the front part 1 and rear part 2 are deformed so that the bag body is expanded, the front part 1 and rear part 2 are kept deformed by the part shape keeping members. While both the front part 1 and rear part 2 are preferably provided with part shape keeping members, only one of them may be provided with a part shape keeping member.

4. Others

While, in the above embodiments, the bag 100 is used as a headphone stand, the use of the bag 100 is not limited to a headphone stand. For example, the bag 100 can be used as an electronic device by inserting an electronic device, such as a speaker, into the front part 1, rear part 2, or any other portion of the bag 100. Also, the bag 100 can be used as an objet d'art by forming a pattern or illustration on the deformed (that is, turned-over) bag 100.

DESCRIPTION OF REFERENCE SIGNS

1: front part, 2: rear part, 3: opening, 4: fastener, 5, 6: connector, 7: deformation promotion part, 8: string member mounting ring, 9: felt, 10: placement surface, 20: headphone, 30: string member, 70: inside support member, 41: slider, 42: tape, 43: element, 51: engagement part, 52: notch, 61: opening, 100: bag

The invention claimed is:

1. A bag comprising:

a bag body comprising a front part and a rear part that face each other;

an opening provided on an upper edge of the bag body; and a shape keeping part that prevents closing of the opening and keeps the bag body expanded, wherein a fastener is disposed on the opening, the shape keeping part includes a pair of connectors and a part shape keeping member, the pair of the connectors are configured to connect to each other, the pair of the connectors are disposed on both ends of the fastener respectively, each of the pair of the connectors is formed in a plate shape, one connector of the pair of the connectors includes an opening portion penetrating the one connector, the other connector of the pair of the connectors includes an engagement part and a notch, the engagement part is closer to a tip of the other connector than the notch, a width of the engagement part is wider than a width of the notch, an engaging portion is configured to, when the notch is inserted into the opening portion of the one connector, be hooked on the one connector, the part shape keeping member is formed of a thin sheet, the part shape keeping member is provided on at least one surface of the front part and the rear part, the part shape keeping member is configured to keep a shape of the surface by the plastically deforming of the part shape keeping member when the surface is deformed, the part shape keeping member keeps a curved shape by the plastic deformation regardless of the connection of the pair of the connectors.

2. The bag of claim 1, wherein the shape keeping part comprises an inside support member disposed inside the bag body and configured to prevent the front part and the rear part from coming close to each other.

3. The bag of claim 1, wherein a deformation promotion part is disposed near a lower edge of the bag body and the deformation promotion part is configured to form a protrusion protruding from a side of the bag body toward the center of the bag body, and the bag body is configured such that deformation of the bag body is promoted by the deformation promotion part and a placement surface is formed around the deformation promotion part.

* * * * *